US011703225B2

(12) United States Patent
Singh et al.

(10) Patent No.: US 11,703,225 B2
(45) Date of Patent: Jul. 18, 2023

(54) SWIRLER OPPOSED DILUTION WITH SHAPED AND COOLED FENCE

(71) Applicant: General Electric Company, Schenectady, NY (US)

(72) Inventors: Saket Singh, Bengaluru (IN); Pradeep Naik, Bengaluru (IN); Rimple Rangrej, Bengaluru (IN); Shai Birmaher, Cincinnati, OH (US); Ranganatha Narasimha Chiranthan, Bengaluru (IN); Ajoy Patra, Bengaluru (IN); Ravindra Shankar Ganiger, Bengaluru (IN); Hiranya Nath, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/663,311

(22) Filed: May 13, 2022

(65) Prior Publication Data

US 2023/0194087 A1 Jun. 22, 2023

(30) Foreign Application Priority Data

Dec. 16, 2021 (IN) ..... 202111058612

(51) Int. Cl.
*F23R 3/06* (2006.01)
*F23R 3/16* (2006.01)

(52) U.S. Cl.
CPC . *F23R 3/06* (2013.01); *F23R 3/16* (2013.01)

(58) Field of Classification Search
CPC ..... F23R 3/04; F23R 3/06; F23R 2900/00015
See application file for complete search history.

(56) References Cited

U.S. PATENT DOCUMENTS 3,504,491 A 4/1970 Wigg
3,626,698 A 12/1971 Baum
3,820,324 A * 6/1974 Grindley et al. ..... F23R 3/04 60/738
4,122,670 A * 10/1978 Reider ..... F23R 3/04 431/352
4,292,801 A * 10/1981 Wilkes ..... F23R 3/34 60/776

(Continued)

FOREIGN PATENT DOCUMENTS

DE 1246325 B 8/1967
DE 1276414 B 8/1968

*Primary Examiner* — William H Rodriguez
(74) *Attorney, Agent, or Firm* — Venable LLP; Edward A. Kmett; Michele V. Frank

(57) ABSTRACT

A combustor liner for a combustor of a gas turbine includes an outer liner extending circumferentially about a combustor centerline, and an inner liner extending circumferentially about the combustor centerline, where the outer liner and the inner liner define a combustion chamber therebetween. At least one of the outer liner and the inner liner includes a dilution flow assembly comprising, (a) an annular slot dilution opening, and (b) a dilution fence extending between an upstream side of the annular slot dilution opening to a downstream side of the annular slot dilution opening, and extending into the combustion chamber, the dilution fence including a plurality of dilution openings therethrough for providing a flow of an oxidizer through the dilution fence into the combustion chamber.

16 Claims, 7 Drawing Sheets

(56) References Cited

U.S. PATENT DOCUMENTS 4,413,477 A * 11/1983 Dean ..... F23R 3/42 60/757
4,887,432 A * 12/1989 Mumford ..... F23R 3/06 60/759
5,077,969 A * 1/1992 Liang ..... F02K 1/822 60/757
5,117,636 A * 6/1992 Bechtel, II ..... F23R 3/002 60/738
5,127,221 A 7/1992 Beebe
5,253,478 A * 10/1993 Thibault, Jr. ..... F23R 3/14 60/753
5,285,631 A * 2/1994 Bechtel, II ..... F23R 3/42 60/776
5,454,221 A * 10/1995 Loprinzo ..... F23R 3/045 60/757
5,487,275 A * 1/1996 Borkowicz ..... F23C 6/047 60/747
5,735,126 A * 4/1998 Schulte-Werning ..... F23R 3/26 431/350
6,427,446 B1 * 8/2002 Kraft ..... F23R 3/06 60/737
6,430,932 B1 * 8/2002 Martling ..... F23R 3/04 60/798
6,446,438 B1 * 9/2002 Kraft ..... F23R 3/005 60/737
6,484,509 B2 * 11/2002 Kraft ..... F23R 3/06 60/776
6,772,595 B2 * 8/2004 Martling ..... F23R 3/286 60/737
6,832,482 B2 * 12/2004 Martling ..... F23R 3/286 60/737
6,865,892 B2 * 3/2005 Garrido ..... F23R 3/005 60/752
6,951,109 B2 * 10/2005 Lemon ..... F23R 3/42 29/890.01
7,513,115 B2 * 4/2009 Stuttaford ..... F23D 14/82 60/737
7,707,836 B1 5/2010 Barnes et al.
8,272,219 B1 * 9/2012 Johnson ..... F23R 3/50 60/750
8,646,277 B2 * 2/2014 Chila ..... F23R 3/06 60/758
8,707,704 B2 * 4/2014 Simons ..... F23R 3/002 60/749
10,253,986 B2 4/2019 Lacy et al.
11,371,701 B1 * 6/2022 Gandikota ..... F23R 3/16
2005/0144953 A1 * 7/2005 Martling ..... F23R 3/34 60/752
2006/0168967 A1 * 8/2006 Simons ..... F23R 3/005 60/752
2009/0019854 A1 * 1/2009 Simons ..... F23R 3/286 60/737
2011/0219776 A1 9/2011 Bunker et al.
2015/0113994 A1 * 4/2015 Hu ..... F23R 3/283 60/759
2021/0003281 A1 1/2021 Amble et al.
2022/0282867 A1 * 9/2022 Gandikota ..... F23R 3/002

* cited by examiner

SWIRLER OPPOSED DILUTION WITH SHAPED AND COOLED FENCE

CROSS REFERENCE TO RELATED APPLICATIONS

The present application claims the benefit of Indian Patent Application No. 202111058612, filed on Dec. 16, 2021, which is hereby incorporated by reference herein in its entirety.

TECHNICAL FIELD

The present disclosure relates to a dilution of combustion gases in a combustion chamber of a gas turbine engine.

BACKGROUND

In conventional gas turbine engines, it has been known to provide a flow of dilution air into a combustion chamber downstream of a primary combustion zone. Conventionally, an annular combustor liner may include both an inner liner and an outer liner forming a combustion chamber between them. The inner liner and the outer liner may include dilution holes through the liners that provide a flow of air (i.e., a dilution jet) from a passage surrounding the annular combustor liner into the combustion chamber. Some applications have been known to use circular holes for providing dilution air flow to the combustion chamber. The flow of air through the circular dilution holes in the conventional combustor mixes with combustion gases within the combustion chamber to provide quenching of the combustion gases. High temperature regions seen behind the dilution jet (i.e., in the wake region of dilution jet) are associated with high $NO_x$ formation. In addition, the circular dilution air jet does not spread laterally, thereby creating high temperatures in-between dilution jets that also contribute to high $NO_x$ formation.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a combustion section of a turbine engine, air flows through an outer passage surrounding a combustor liner, and through an inner passage surrounding the combustor liner. The air generally flows from an upstream end of the combustor liner to a downstream end of the combustor liner. Some of the airflow in both the outer passage and the inner passage is diverted through dilution holes in the combustor liner and into the combustion chamber as dilution air. One purpose of the dilution airflow is to cool (i.e., quench) combustion gases within the combustion chamber before the gases enter a turbine section. However, quenching of the product of combustion from the primary zone must be done quickly and efficiently so that regions of high temperature can be minimized, and thereby $NO_x$ emissions from the combustion system can be reduced.

The present disclosure aims to reduce the $NO_x$ emissions by improving the dilution quenching of the hot combustion gases from the primary combustion zone. According to the present disclosure, a combustor liner includes a dilution flow assembly that has a dilution fence extending into the combustion chamber. The dilution fence includes an upstream wall and a downstream wall, and a plurality of dilution openings extending through the upstream wall to provide a flow of dilution air into the combustion chamber in an opposing direction to a flow of combustion gases. That is, the dilution openings in the upstream wall of the dilution fence are arranged to provide a flow of dilution air in an upstream direction, which opposes the flow of combustion gases that flow in the downstream direction. As a result, better mixing and higher turbulence of the dilution air with the combustion gases can be achieved, thereby reducing the $NO_x$ emissions. In addition, the downstream wall may also include a plurality of dilution openings, or cooling passages, so as to provide surface cooling of the liner downstream of the dilution fence, and also to reduce a wake region that may occur at an apex of the fence within the combustion chamber. By reducing the wake region, the $NO_x$ emissions are further reduced.

Figure 1:
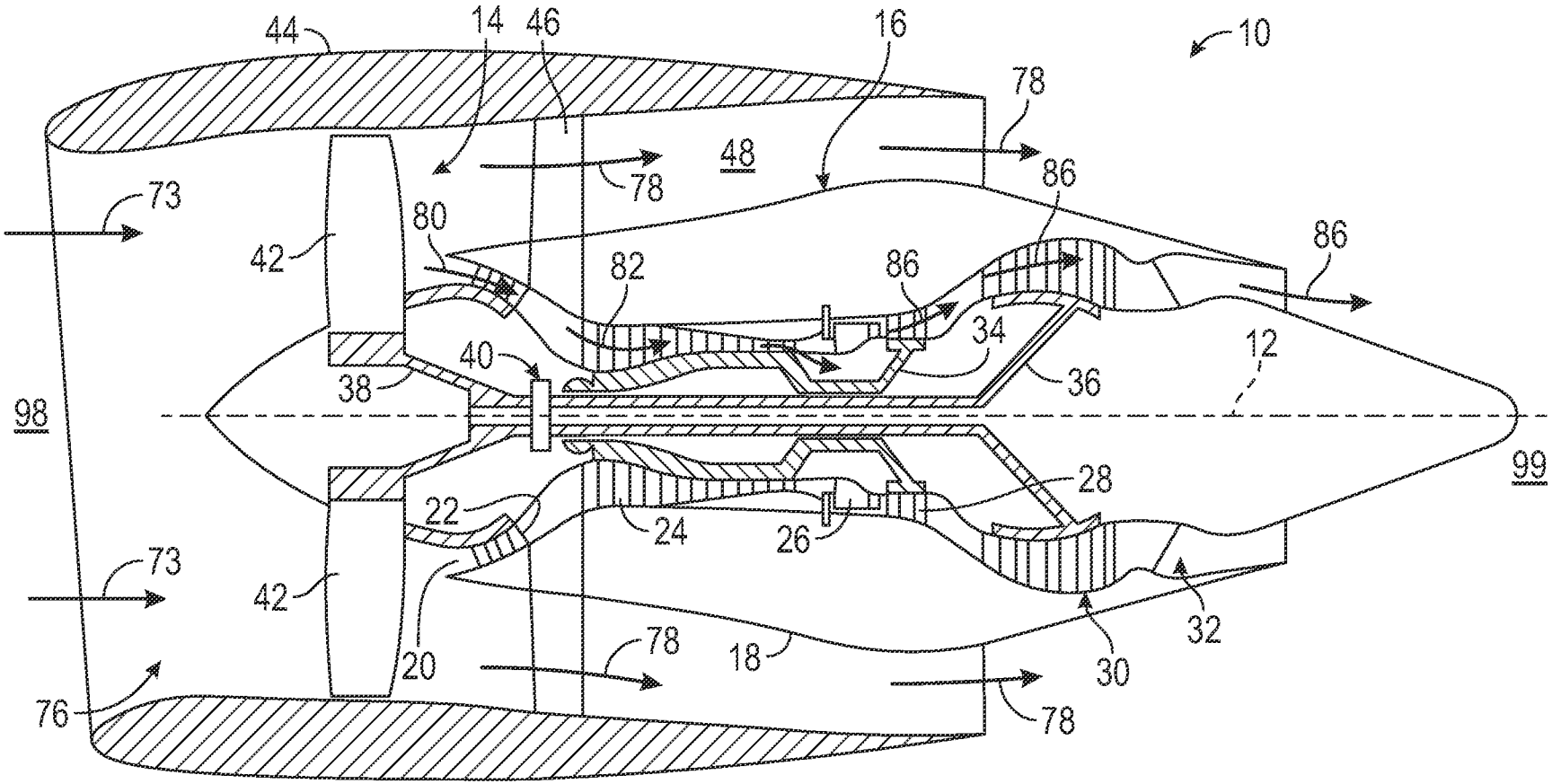
FIG. 1 is a schematic partially cross-sectional side view of an exemplary high by-pass turbofan jet engine, according to an aspect of the present disclosure.

Referring now to the drawings, FIG. 1 is a schematic partially cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal axis or an axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section (22/24) having a booster or low pressure (LP) compressor 22 and a high pressure (HP) compressor 24, a combustor 26, a turbine section (28/30), including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive configuration or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to and that extend radially outwardly from the fan shaft 38. An annular fan casing, or nacelle 44, circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16, so as to define a bypass airflow passage 48 therebetween.

Figure 2:
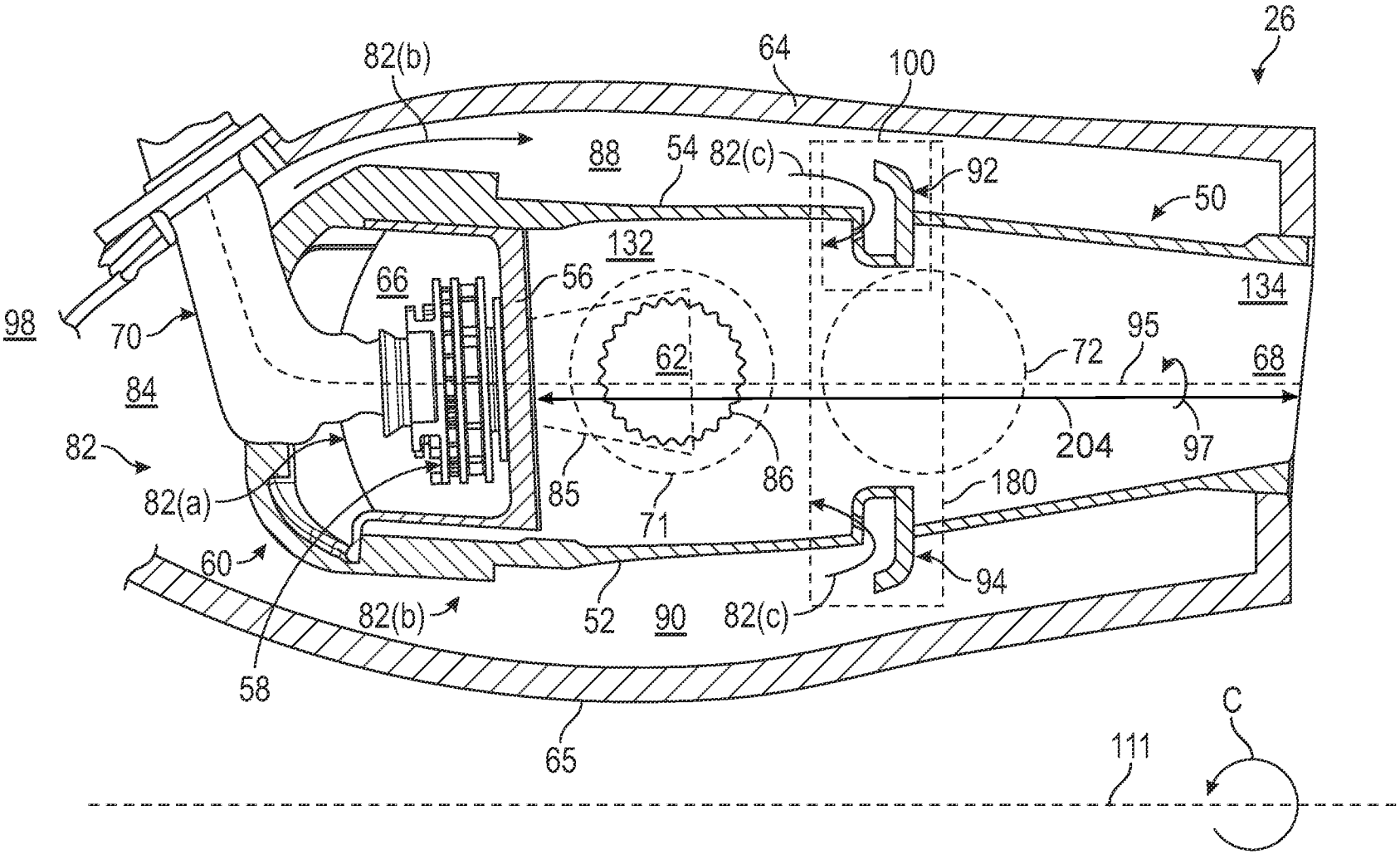
FIG. 2 is a cross-sectional side view of an exemplary combustion section, according to an aspect of the present disclosure.

FIG. 2 is a cross-sectional side view of an exemplary combustor 26 of the core engine 16 as shown in FIG. 1. As shown in FIG. 2, the combustor 26 may generally define a combustor centerline 111, that may correspond to the engine axial centerline axis 12, and, while FIG. 2 depicts a cross-sectional view, the combustor 26 extends circumferentially about the combustor centerline 111. The combustor 26 includes a combustor liner 50 having an inner liner 52 and an outer liner 54, a cowl 60, and a dome assembly 56. The outer liner 54 and the inner liner 52 extend circumferentially about the combustor centerline 111. The dome assembly 56 extends radially between the outer liner 54 and the inner liner 52 and also extends circumferentially about the combustor centerline 111. Together, the inner liner 52, the outer liner 54, and the dome assembly 56 define a combustion chamber 62 that extends circumferentially about the combustor centerline 111, and that extends from an upstream end 132 to a downstream end 134. The combustion chamber 62 may more specifically define various regions, including a primary combustion zone 71 at which initial chemical reaction of a fuel-oxidizer mixture and/or recirculation of combustion gases 86 may occur before flowing further downstream to dilution zone 72. In dilution zone 72, as will be described in more detail below, the combustion gases 86 may be mixed with compressed air 82(*c*) before flowing through a turbine inlet 68 to the HP turbine 28 and the LP turbine 30 (FIG. 1).

As shown in FIG. 2, the inner liner 52 may be encased within an inner casing 65 and the outer liner 54 may be encased within an outer casing 64. An outer oxidizer flow passage 88 is defined between the outer casing 64 and the outer liner 54, and an inner oxidizer flow passage 90 is defined between the inner casing 65 and the inner liner 52. The outer liner 54 may include an outer liner dilution flow assembly 92, and the inner liner 52 may include an inner liner dilution flow assembly 94. Both the outer liner dilution flow assembly 92 and the inner liner dilution flow assembly 94 may extend circumferentially about the combustor centerline 111. Various aspects of the outer liner dilution flow assembly 92 and the inner liner dilution flow assembly 94, as well as a relationship between them within the combustor 26, will be described in more detail below. Generally, the outer liner dilution flow assembly 92 and the inner liner dilution flow assembly 94 provide a flow of compressed air 82(*c*) therethrough and into the dilution zone 72 of the combustion chamber 62. The flow of compressed air 82(*c*) can thus be utilized to provide quenching of the combustion gases 86 in the dilution zone 72 so as to cool the flow of combustion gases 86 entering the turbine section (28/30).

In the cross-sectional view of FIG. 2, the combustor 26 is seen to include a swirler assembly 58 and a fuel nozzle assembly 70 connected with the swirler assembly 58. As is generally known, however, the combustor 26 includes a plurality of swirler assemblies 58 connected to respective openings (not shown) in the dome assembly 56, with the plurality of swirler assemblies 58 being circumferentially spaced about the combustor centerline 111. Similarly, a plurality of fuel nozzle assemblies 70 are provided for the respective plurality of swirler assemblies 58. Thus, the cross-sectional view depicted in FIG. 2 is merely representative of one of the plurality of swirler assemblies 58 and the fuel nozzle assemblies 70.

During operation of the engine 10, as shown in FIGS. 1 and 2 collectively, a volume of air 73, as indicated schematically by arrows, enters the engine 10 from the upstream end 98 through an associated inlet 76 of the nacelle 44 and/or the fan assembly 14. As the volume of air 73 passes across the fan blades 42, a portion of the air 73, as indicated schematically by arrows 78, is directed or routed into the bypass airflow passage 48, while another portion of the air 80, as indicated schematically by an arrow, is directed or routed into the LP compressor 22. The air 80 is progressively compressed as it flows through the LP compressor 22 and the HP compressor 24 towards the combustor 26.

Referring to FIG. 2, the now compressed air 82, as indicated schematically by an arrow, flows into a diffuser cavity 84 of the combustor 26 and pressurizes the diffuser cavity 84. A first portion of the compressed air 82(*a*), as indicated schematically by arrows, flows from the diffuser cavity 84 into a pressure plenum 66 within the cowl 60, where it is then swirled and mixed with fuel provided from the fuel nozzle assembly 70, by the swirler assembly 58 to generate the swirled fuel/oxidizer mixture 85 that is then ignited and burned to generate the combustion gases 86. The swirled fuel/oxidizer mixture 85 may be swirled about a swirler centerline 95 in a swirler flow direction 97, that may be either clockwise about the swirler centerline 95 or may be counterclockwise about the swirler centerline 95. A second portion of the compressed air 82 entering the diffuser cavity 84, as indicated schematically by arrows, compressed air 82(*b*) may be used for various purposes other than combustion. For example, as shown in FIG. 2, compressed air 82(*b*) may be routed into the outer oxidizer flow passage 88 and into the inner oxidizer flow passage 90. A portion of the compressed air 82(*b*) may then be routed from the outer oxidizer flow passage 88 through the outer liner dilution flow assembly 92 (schematically shown with an arrow as compressed air 82(*c*)) and into the dilution zone 72 of combustion chamber 62 to provide quenching of the combustion gases 86 in dilution zone 72. The compressed air 82(*c*) may also provide turbulence to the flow of the combustion gases 86 so as to provide better mixing of the compressed air 82(*c*) with the combustion gases 86. A similar flow of the compressed air 82(*c*) from the inner oxidizer flow passage 90 through the inner liner dilution flow assembly 94 of the inner liner 52 occurs. In addition, or in the alternative, at least a portion of compressed air 82(*b*) may be routed out of the diffuser cavity 84 through various flow passages (not shown) to provide cooling air to at least one of the HP turbine 28 or the LP turbine 30.

Referring back to FIGS. 1 and 2 collectively, the combustion gases 86 generated in the combustion chamber 62 flow from the combustor 26 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at downstream end 99.

Figure 3:
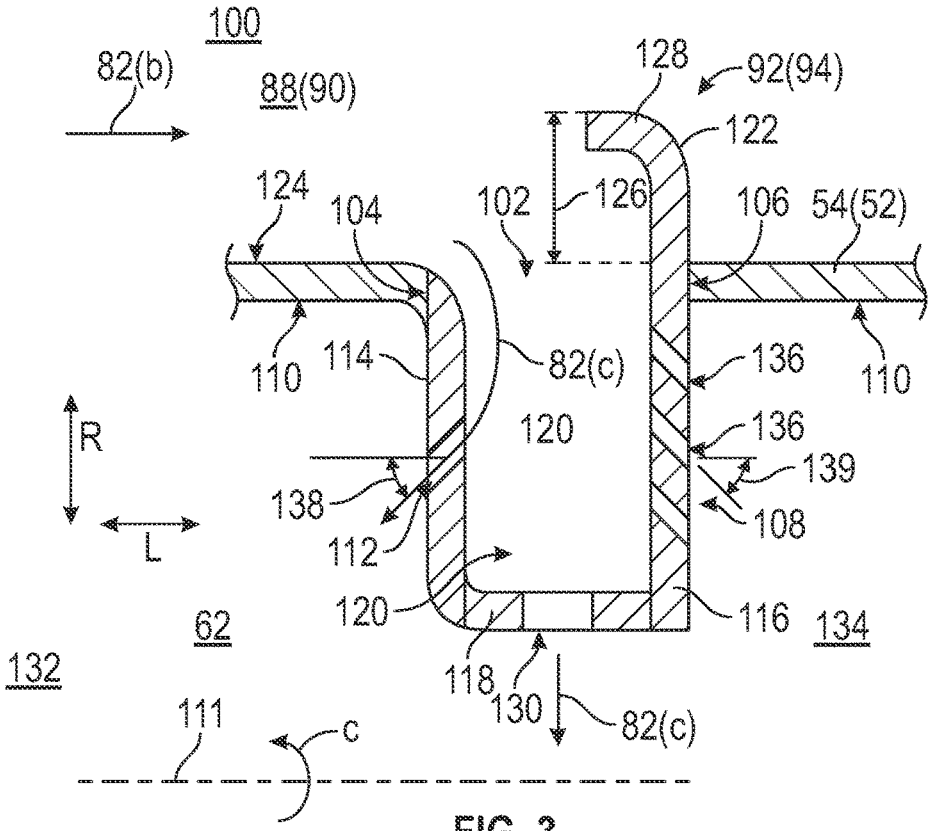
FIG. 3 depicts a partial cross-sectional view of a dilution flow assembly taken at detail view 100 of FIG. 2, according to an aspect of the present disclosure.

FIG. 3 is a partial cross-sectional view of a dilution flow assembly taken at detail view 100 of FIG. 2. While FIG. 3 depicts the outer liner dilution flow assembly 92, it can readily be understood that FIG. 3 is also applicable to the inner liner dilution flow assembly 94, albeit in a mirror image arrangement. Thus, some elements in FIG. 3 include corresponding reference numerals in parentheses for the inner liner counterpart elements. The outer liner dilution flow assembly 92 extends circumferentially about the combustor centerline 111, and in the FIG. 3 aspect, is seen to include an annular slot dilution opening 102 that has an upstream side 104 and a downstream side 106. The annular slot dilution opening 102 extends circumferentially about the combustor centerline 111 through the outer liner 54. The outer liner dilution flow assembly 92 also includes a dilution fence 108 that extends from the upstream side 104 of the annular slot dilution opening 102 to the downstream side 106 of the annular slot dilution opening 102. The dilution fence 108 also extends in the radial direction (R) into the combustion chamber 62 from a hot surface side 110 of the outer liner 54. The dilution fence 108 also includes a plurality of dilution openings 112 therethrough for providing a flow of an oxidizer through the dilution fence 108 into the combustion chamber 62.

The dilution fence 108 in the FIG. 3 aspect is seen to include an upstream wall 114 extending from the upstream side 104 of the annular slot dilution opening 102 into the combustion chamber 62, and a downstream wall 116 extending from the downstream side 106 of the annular slot dilution opening 102 into the combustion chamber 62. The downstream wall 116 may further include a deflector portion 122 that extends from a cold surface side 124 of the outer liner 54 into the outer oxidizer flow passage 88. A height 126 of the deflector portion 122 of the downstream wall 116 may be varied depending on an amount of oxidizer (compressed air 82(*b*)) to be deflected from the outer oxidizer flow passage 88 into a dilution flow channel 120. In addition, an outer portion 128 of the deflector portion 122 may be shaped (e.g., a scoop shape) so as direct the flow of oxidizer (compressed air 82(*b*)) into the dilution flow channel 120.

The dilution fence 108 in the FIG. 3 aspect is further seen to include an axial connecting wall 118 that extends in a longitudinal direction (L) and connects the upstream wall 114 and the downstream wall 116 within the combustion chamber 62. In other aspects, as will be described below, the axial connecting wall 118 may be omitted and the upstream wall 114 and the downstream wall 116 may be connected together instead. The dilution flow channel 120 of the FIG. 3 aspect is defined between the annular slot dilution opening 102, the upstream wall 114, the downstream wall 116, and the axial connecting wall 118. The axial connecting wall 118 may include a plurality of dilution jets 130 therethrough that are circumferentially spaced about the combustor centerline 111. The plurality of dilution jets 130 may provide a radial flow of the oxidizer (compressed air 82(*c*)) from the dilution flow channel 120 into the combustion chamber 62 in the radial direction (R). However, the dilution jets 130 may be angled (not shown) to direct the flow of oxidizer (compressed air 82(*c*)) toward the upstream end 132 of the combustion chamber 62 or toward the downstream end 134 of the combustion chamber 62.

The plurality of dilution openings 112 may be provided through at least one of the upstream wall 114 and the downstream wall 116 (not shown in FIG. 3). Alternatively, rather than providing a plurality of dilution openings 112 through the downstream wall 116, a plurality of cooling passages 136 may be provided through the downstream wall 116. The cooling passages 136 provide for some of the compressed air 82(*b*) from the dilution flow channel 120 to flow through the downstream wall so as to provide cooling of the downstream surface of the downstream wall 116, and to provide some cooling air to also flow near the hot surface side 110 of the outer liner 54. In the FIG. 3 aspect, the plurality of dilution openings 112 may be arranged at an angle 138 in an upstream direction toward the upstream end 132 with respect to the combustor centerline 111. Similarly, the cooling passages 136 may be arranged at an angle 139 in the downstream direction toward the downstream end 134.

Figure 4:
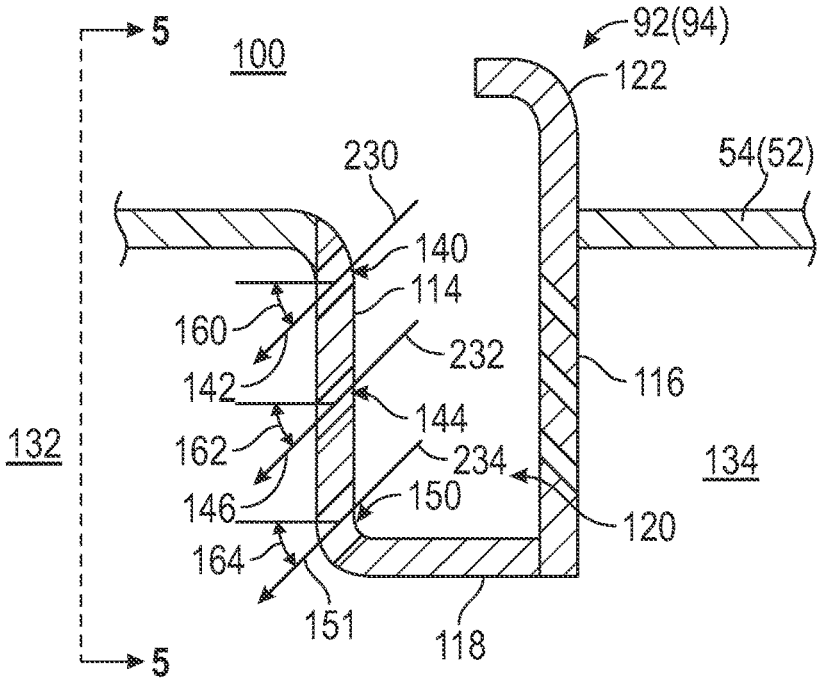
FIG. 4 depicts a partial cross-sectional view of a dilution flow assembly taken at detail view 100 of FIG. 2, according to another aspect of the present disclosure.
Figure 5:
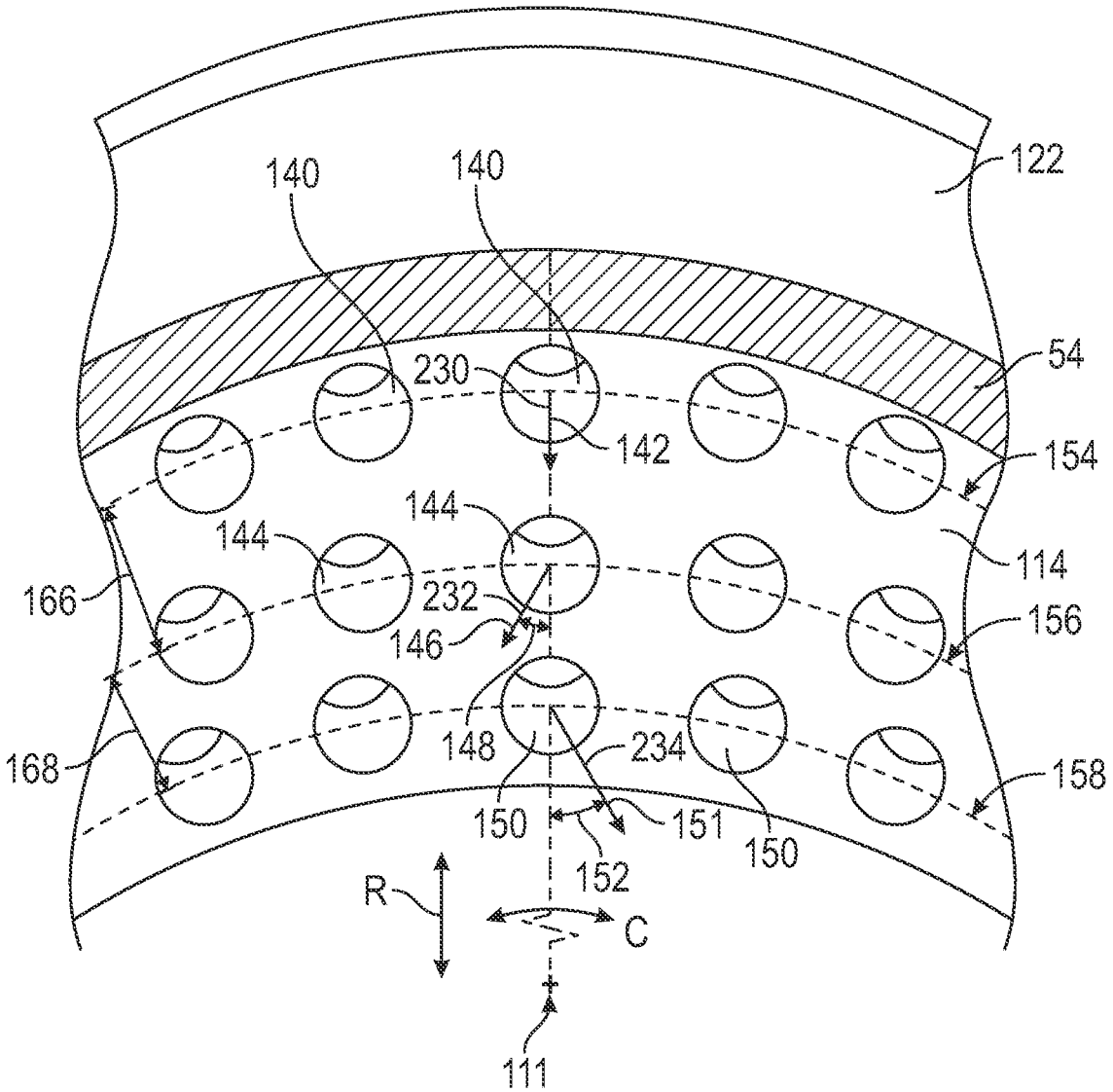
FIG. 5 depicts a partial cross-sectional aft looking view of a dilution flow assembly, taken at plane 5-5 of FIG. 4, according to an aspect of the present disclosure.
Figure 6:
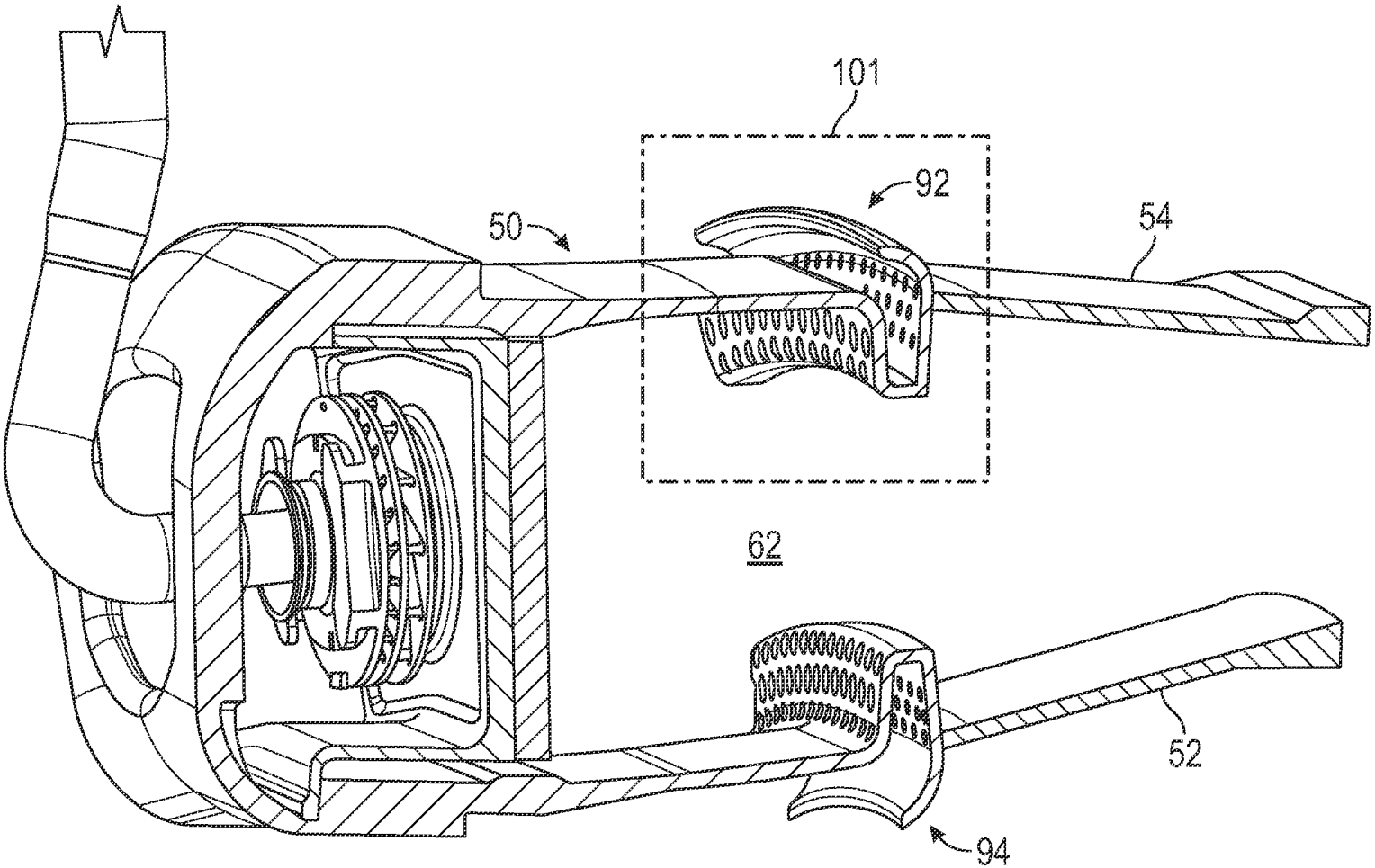
FIG. 6 depicts a forward aft-looking partial cutaway perspective view of a combustor, according to an aspect of the present disclosure.
Figure 7:
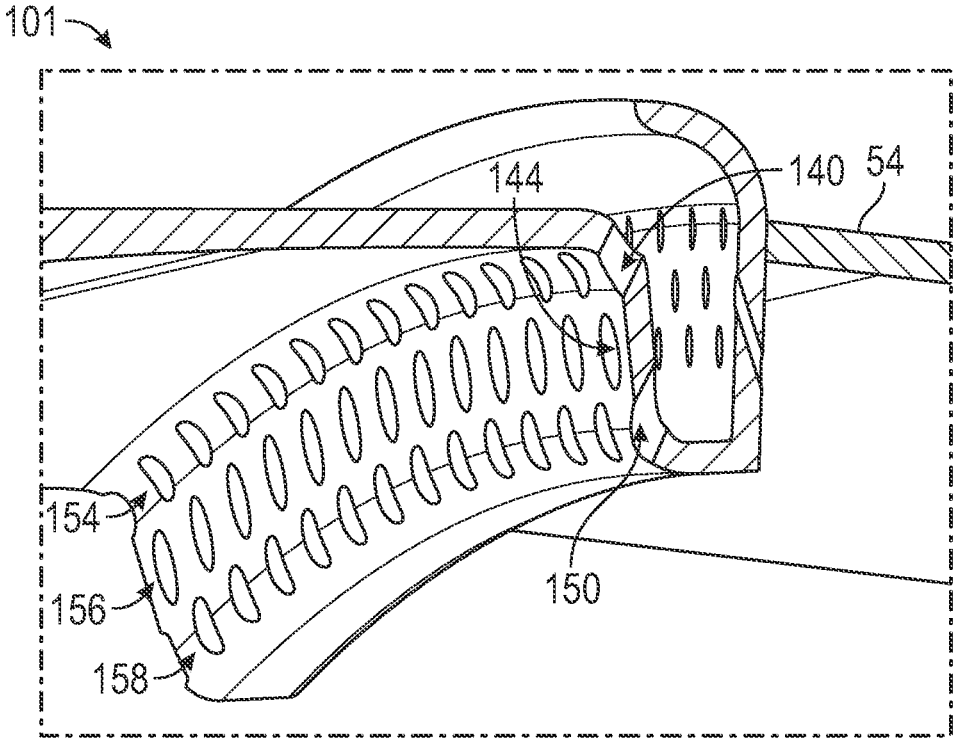
FIG. 7 depicts an enlarged view of a dilution flow assembly shown in FIG. 6, taken at view 101, according to an aspect of the present disclosure.

Referring now to FIGS. 4 to 7, another arrangement of dilution openings through the upstream wall 114 will be described. FIG. 4, like FIG. 3, is a partial cross-sectional side view of the inner liner dilution flow assembly 94 taken at detail view 100 of FIG. 2. FIG. 5 is a partial cross-sectional aft-looking view taken at plane 5-5 of FIG. 4. FIG. 6 is a forward aft-looking cutaway sectional view of a portion of a combustor 26 shown in FIG. 2, and FIG. 7 is an enlarged perspective view taken at view 101 of FIG. 6. In the aspect of FIGS. 4 to 7, the plurality of dilution openings are seen to be arranged through the upstream wall 114 in a plurality of rows, including a first row 154 of dilution openings 140, a second row 156 of dilution openings 144, and a third row 158 of dilution openings 150. Each of the first row 154, the second row 156, and the third row 158 extends circumferentially about the combustor centerline 111, and each row is radially offset from the other rows. For example, the first row 154 of the plurality of dilution openings 140 has a radial offset distance 166 with the second row 156 of dilution openings 144, and the second row 156 of dilution openings 144 has a radial offset distance 168 with the third row 158 of dilution openings 150, where the radial distance is taken with respect to the combustor centerline 111. Additionally, as generally shown in FIG. 7, the dilution openings of one row (e.g., the dilution openings 140 of the first row 154) may be circumferentially offset from the dilution openings of another row (e.g., the dilution openings 144 of the second row 156).

Referring back to FIG. 4, the plurality of dilution openings 140 of the first row 154 are seen to be arranged to direct a flow 230 of the oxidizer (compressed air 82(*c*)) from the dilution flow channel 120 into the combustion chamber 62 in a first direction 142. For example, the dilution openings 140 may be arranged at an angle 160 to provide the flow 230 of oxidizer (compressed air 82(*c*)) in the first direction 142 toward the upstream end 132 of the combustion chamber, and as shown in FIG. 5, the first direction 142 may be in the radial direction (R) toward the combustor centerline 111. On the other hand, the plurality of dilution openings 144 of the second row 156 may be arranged at an angle 162 to direct a flow 232 of the oxidizer (compressed air 82(*a*)) from the dilution flow channel 120 into the combustion chamber 62 in a second direction 146 toward the upstream end 132, where the angle 162 may be different from the angle 160. Additionally, referring to FIG. 5, the plurality of dilution openings 144 of the second row 156 may be arranged at an angle 148 with respect to the circumferential direction (C) so as to direct the flow 232 of oxidizer (compressed air 82(*c*)) at least partially laterally within the combustion chamber 62. Yet further, the plurality of dilution openings 150 of the third row 158 may be arranged at an angle 164 to direct a flow 234 of the oxidizer (compressed air 82(*a*)) from the dilution flow channel 120 into the combustion chamber 62 in a third direction 151 toward the upstream end 132, where the angle 164 may be different from the angle 160 and from the angle 162. Additionally, referring to FIG. 5, the plurality of dilution openings 150 of the third row 158 may be arranged at an angle 152 with respect to the circumferential direction (C) so as to direct the flow 234 of oxidizer (compressed air 82(*c*)) at least partially laterally within the combustion chamber 62 in a lateral direction opposite that of the second direction 146. Thus, with the dilution openings 140 providing for the flow 230 of oxidizer in the first direction 142, the dilution openings 144 providing the flow 232 of oxidizer in the second direction 146 different from the first direction 142, and the dilution openings 150 providing the flow 234 of oxidizer in the third direction 151 different from both the first direction 142 and the second direction 146, a better mixing of the compressed air 82(*c*) with the combustion gases 86 within the combustion chamber 62 can be obtained. In addition, by providing the dilution openings 140, 144, and 150 through the upstream wall 114 so that the flows 230, 232, 234 of oxidizer through each of the dilution openings 140, 144 and 150 are in the upstream direction toward the upstream end 132 of the combustion chamber 62 (see FIG. 2), the flows 230, 232, and 234 are in an opposing direction with a downstream flow of the combustion gases 86, thereby providing for greater turbulence in the mixing of the combustion gases 86 with the oxidizer (compressed air 82(*c*)). As a result, a wake that may otherwise form at the trailing edge of the conventional dilution holes can be reduced, thereby reducing $NO_x$ gas emissions within the combustor.

Figure 8:
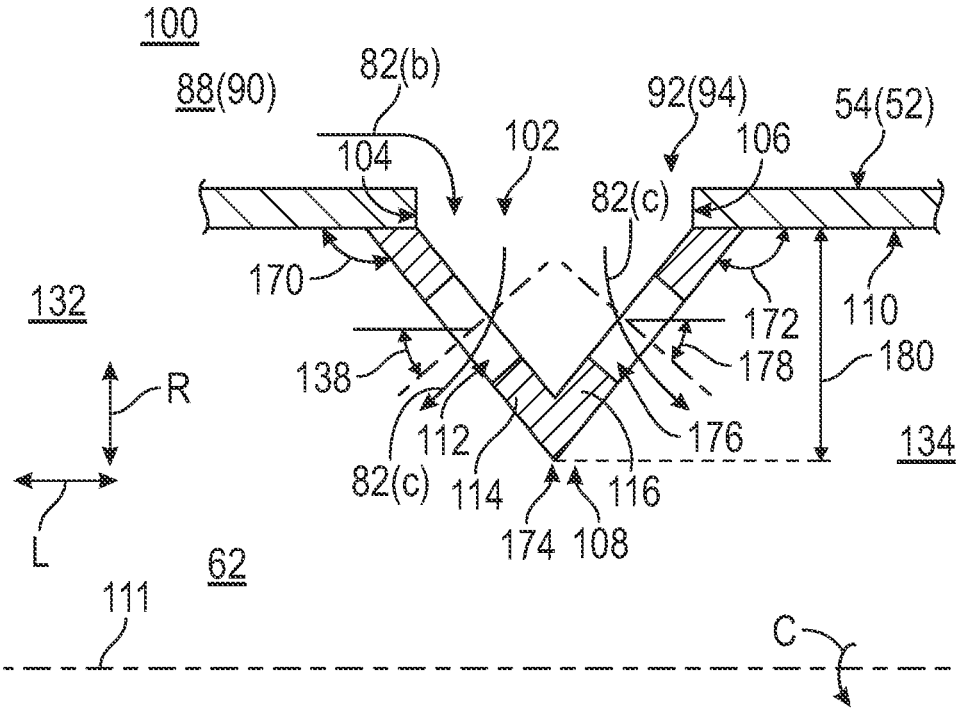
FIG. 8 depicts a partial cross-sectional view of a dilution flow assembly taken at detail view 100 of FIG. 2, according to yet another aspect of the present disclosure.

FIG. 8 depicts another aspect of the outer liner dilution flow assembly 92, taken at detail view 100 of FIG. 2. In the FIG. 8 aspect, the axial connecting wall 118 is omitted and the upstream wall 114 and the downstream wall 116 are connected to one another. The upstream wall 114 is arranged at an upstream wall angle 170 and extends from the upstream side 104 of the annular slot dilution opening 102 toward the downstream end 134, and extends into the combustion chamber 62. The upstream wall angle 170 may have a range from ten to one-hundred-sixty degrees. Of course, other angles could be implemented instead. The downstream wall 116 extends from the downstream side 106 of the annular slot dilution opening 102 at a downstream wall angle 172 and extends toward the upstream end 132 into the combustion chamber 62. The downstream wall angle 172 may have a range from ten to one-hundred-sixty degrees, but of course, other angles could be implemented instead. The upstream wall 114 and the downstream wall 116 define an apex 174 at a connection between the upstream wall 114 and the downstream wall 116 within the combustion chamber 62. The upstream wall 114 and the downstream wall 116 may be connected together via, for example, being brazed or welded together so as to define the apex 174. Alternatively, the upstream wall 114 and the downstream wall 116 may be formed integral with one another by, for example, being additively manufactured, or formed via known metal forming processes. Similar to the FIG. 3 aspect, the upstream wall 114 in the FIG. 8 aspect includes the plurality of dilution openings 112, which may be arranged at the angle 138. In the FIG. 8 aspect, however, the downstream wall 116 is shown as including a plurality of downstream wall dilution openings 176 therethrough. The downstream wall dilution openings 176 may be arranged at an angle 178 in the downstream direction toward the downstream end 134. While the dilution openings 112 through the upstream wall 114 may provide for increased mixing of the compressed air 82(*c*) with the combustion gases 86 in the primary combustion zone 71, the compressed air 82(*c*) through the downstream wall dilution openings 176 may provide for mixing downstream of the dilution fence 108 and also helps to trim the combustor exit temperature profile.

Figure 9:
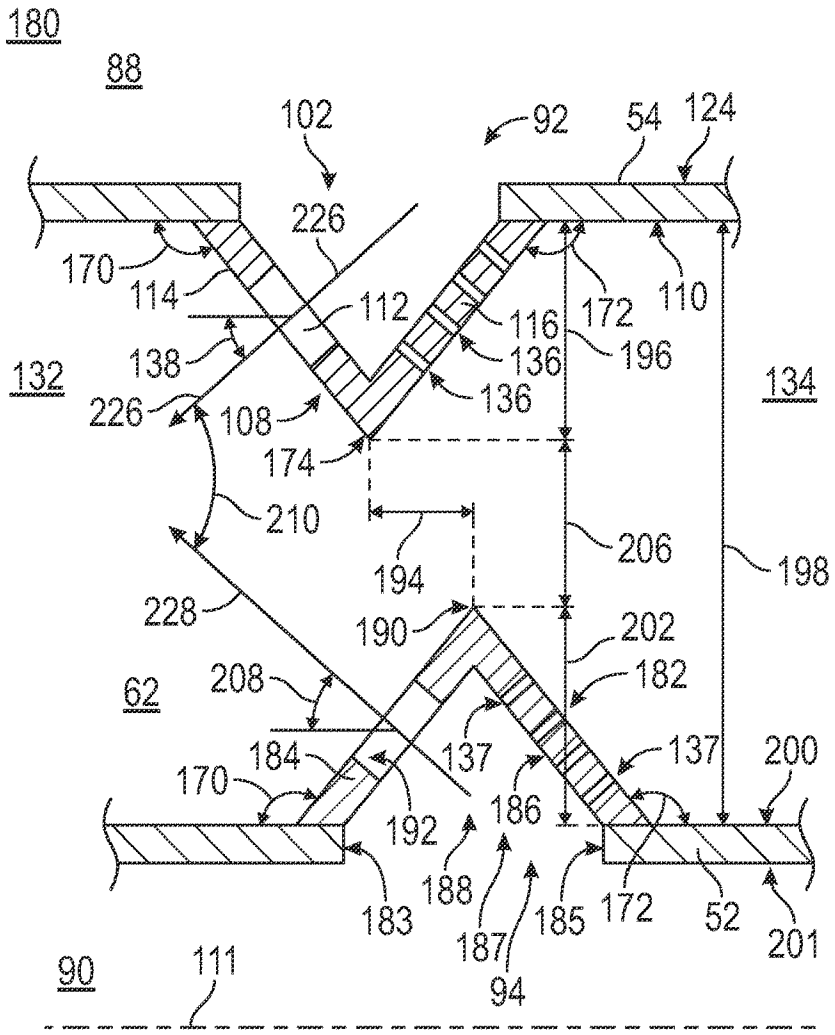
FIG. 9 depicts a partial cross-sectional view of a relationship between an inner liner dilution flow assembly and an outer liner dilution flow assembly, taken at detail view 180 of FIG. 2, according to an aspect of the present disclosure.

FIG. 9 depicts a partial cross-sectional view taken at detail view 180 of FIG. 2. In FIG. 9, a relationship between the dilution fence 108 of the outer liner dilution flow assembly 92, and a dilution fence 182 of the inner liner dilution flow assembly 94, will be described. The dilution fence 182 is similar to the dilution fence 108 described above for FIG. 8 and may be a mirror image of the dilution fence 108. Thus, the dilution fence 182 may extend from an upstream side 183 of an annular slot dilution opening 188 to a downstream side 185 of the annular slot dilution opening 188. In FIG. 9, however, the downstream wall dilution openings 176 are omitted from the downstream wall 116, and, instead, the downstream wall 116 may include the cooling passages 136. The dilution fence 182 includes the upstream wall 184 similar to the upstream wall 114 and a downstream wall 186 that connect together to form an apex 190 similar to the apex 174. The annular slot dilution opening 188 is similar to the annular slot dilution opening 102, and extends through the inner liner 52. A dilution flow channel 187, similar to the dilution flow channel 120 of FIGS. 3 and 4, is formed between the upstream wall 184, the downstream wall 186 and the annular slot dilution opening 188. The upstream wall 184 includes a plurality of dilution openings 192 that extend therethrough, similar to the plurality of dilution openings 112 of the upstream wall 114. The downstream wall 186 may include a plurality of cooling passages 137, which may be similar to the cooling passages 136 through the downstream wall 116. Like the outer liner 54, the inner liner 52 includes a hot surface side 200 and a cold surface side 201.

The outer liner dilution flow assembly 92 may be offset in the longitudinal direction (L) with respect to the inner liner dilution flow assembly 94. For example, the apex 174 of the outer liner dilution flow assembly 92 and the apex 190 of the inner liner dilution flow assembly 94 may be offset by an offset distance 194, in the longitudinal direction (L) with respect to one another. The offset distance 194 may range from zero percent to thirty percent of a combustor length 204 (FIG. 2) of the combustor 26. Of course, when the offset distance 194 is zero percent of the combustor length 204, the apex 174 and the apex 190 are radially aligned with one another. The apex 174 may be arranged at a height 196 from the hot surface side 110 of the outer liner 54. The height 196 may range from ten percent to forty-five percent of a height 198 of the combustion chamber 62 taken between the hot surface side 110 of the outer liner 54 at the annular slot dilution opening 102 and the hot surface side 200 of the inner liner 52 taken at the annular dilution opening 188. A height 202 of the apex 190 may be similarly taken with respect to the hot surface side 200 of the inner liner 52 as a percentage of the height 198, and may similarly have a range from ten percent to forty-five percent of the height 198. A radial distance 206 between the apex 174 and the apex 190 may have a range from zero percent to forty percent of the height 198. Of course, when the radial distance 206 is zero percent of the height 198, the apex 174 and the apex 190 would need to have a larger offset distance 194 in order to provide for a proper flow of the combustion gases 86 downstream of the dilution zone 72 (FIG. 2). The radial distance 206 is not limited to the foregoing range and other distance values may be implemented instead.

In FIG. 9, like FIG. 3, the plurality of dilution openings 112 through the upstream wall 114 of the outer liner dilution flow assembly 92 are arranged to direct the flow 226 of oxidizer (i.e., compressed air 82(*c*)) toward the upstream end 132 at the angle 138. Similarly, the plurality of dilution openings 192 through the upstream wall 184 of the inner liner dilution flow assembly 94 are arranged to direct a flow 228 of oxidizer (compressed air 82(*c*)) toward the upstream end 132 at an angle 208. Thus, a converging flow angle 210 is defined between the angle 138 and the angle 208. The converging flow angle 210 may have a range from fifty degrees to one-hundred-eighty degrees. Of course, the converging flow angle 210 is not limited to the foregoing range and other angle values may be implemented instead.

Figure 10:
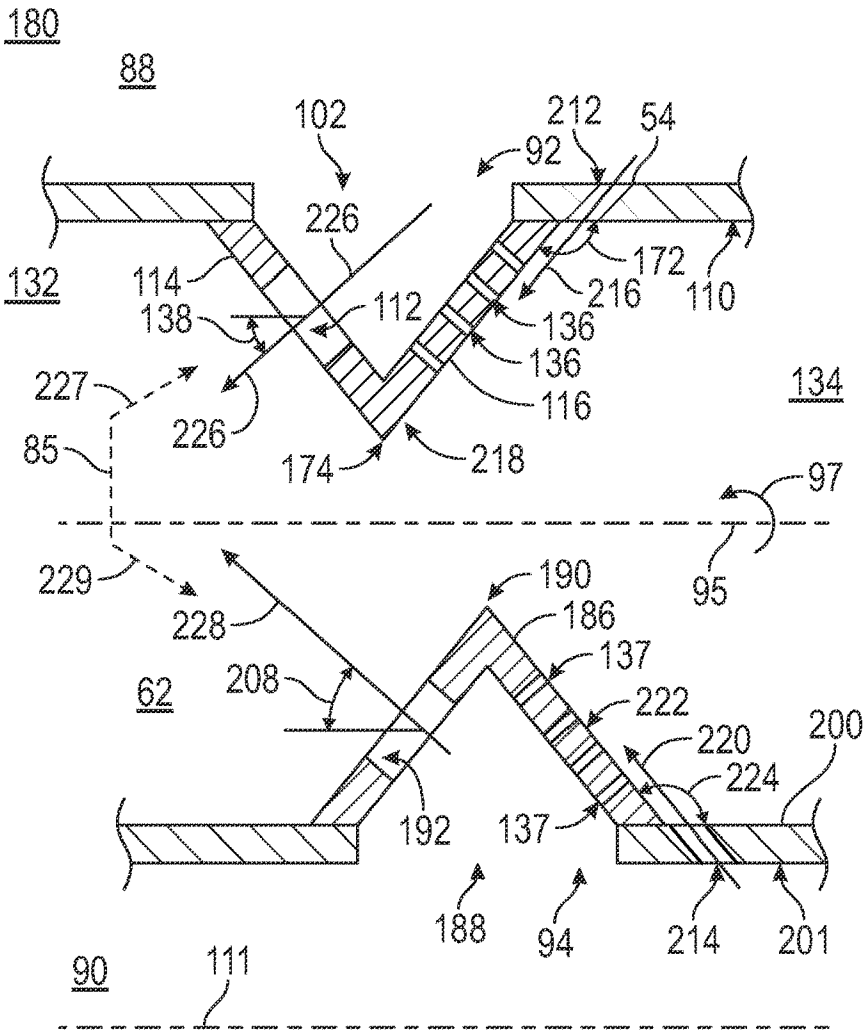
FIG. 10 depicts a partial cross-sectional view of a relationship between an inner liner dilution flow assembly and an outer liner dilution flow assembly, taken at detail view 180 of FIG. 2, according to another aspect of the present disclosure.

FIG. 10 depicts another arrangement of dilution flow assemblies according to another aspect of the present disclosure. The arrangement depicted in FIG. 10 is similar to that shown in FIG. 9, but, as shown in FIG. 10, a second plurality of outer liner dilution openings 212 are provided through the outer liner 54 downstream of the downstream wall 116 of the outer liner dilution flow assembly 92, and a second plurality of inner liner dilution openings 214 are provided through the inner liner 52 downstream of the downstream wall 186 of the inner liner dilution flow assembly 94. The second plurality of outer liner dilution openings 212 may be arranged at the downstream wall angle 172 of the downstream wall 116 so that a flow of oxidizer 216 through the second plurality of outer liner dilution openings 212 flows against a downstream side 218 of the downstream wall 116 so as to provide surface cooling of the downstream wall 116. In addition, the flow of oxidizer 216 impinges with the flow of combustion gases 86 as the apex 174 so as to reduce a wake that may occur on a downstream side of the apex 174, thereby reducing $NO_x$ emissions that otherwise may occur in the wake. Similarly, the second plurality of inner liner dilution openings 214 may be arranged at a downstream wall angle 224 of the downstream wall 186 so that a flow of oxidizer 220 through the second plurality of inner liner dilution openings 214 flows against a downstream side 222 of the downstream wall 186 so as to provide surface cooling of the downstream wall 186. In addition, the flow of oxidizer 220 impinges with the flow of combustion gases 86 at the apex 190 so as to reduce a wake that may occur on a downstream side of the apex 190, thereby reducing $NO_x$ emissions that otherwise may occur in the wake.

As was described above, the plurality of dilution openings 112 may be arranged at the angle 138 to provide the flow 226 of oxidizer in the upstream direction toward the upstream end 132 of the combustion chamber 62, and the plurality of dilution openings 192 may be arranged at the angle 208 to provide the flow 228 of oxidizer in the upstream direction toward the upstream end 132 of the combustion chamber 62. Thus, the angle 138 may be arranged so as to provide for the flow 226 to oppose a flow direction 227 of the fuel/oxidizer mixture 85 from the swirler assembly 58 (FIG. 2), and the angle 208 may be arranged so as to provide for the flow 228 to oppose a flow direction 229 of the swirled fuel/oxidizer mixture 85 from the swirler assembly 58. The plurality of dilution openings 112 and the plurality of dilution openings 192 may, however, also be arranged with a circumferential angle (not shown) to provide the flow 226 of oxidizer and the flow 228 of oxidizer in a circumferential direction with respect to the swirler centerline 95. For example, the plurality of dilution openings 112 and the plurality of dilution openings 192 may include a circumferential angle such as was described above with regard to the flow 232 of oxidizer provided by the plurality of dilution openings 144 in the second row 156 of FIG. 5, or such as with the description above with regard to the flow 234 of oxidizer provided by the plurality of dilution openings 150 of FIG. 5. As was discussed above, the swirled fuel/oxidizer mixture 85 injected into the combustion chamber 62 may be swirled about the swirler centerline 95 in the swirler flow direction 97. Thus, some of the plurality of dilution openings 112 that are arranged through the upstream wall 114, and circumferentially opposing the swirler assembly 58, may be arranged to include a circumferential angle component such that the flow 226 and the flow 228 may be either co-directional with the swirler flow direction 97, or may be counter-directional with the swirler flow direction 97.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A combustor liner for a combustor of a gas turbine, the combustor liner comprising: an outer liner extending circumferentially about a combustor centerline; and an inner liner extending circumferentially about the combustor centerline, wherein, the outer liner and the inner liner define a combustion chamber therebetween, and at least one of the outer liner and the inner liner includes a dilution flow assembly comprising, (a) an annular slot dilution opening, and (b) a dilution fence extending between an upstream side of the annular slot dilution opening to a downstream side of the annular slot dilution opening, and extending into the combustion chamber, the dilution fence including a plurality of dilution openings therethrough for providing a flow of an oxidizer through the dilution fence into the combustion chamber.

The combustor liner according to any preceding clause, wherein the dilution fence includes (i) an upstream wall extending from the upstream side of the annular slot dilution opening into the combustion chamber and (ii) a downstream wall extending from the downstream side of the annular slot dilution opening into the combustion chamber.

The combustor liner according to any preceding clause, wherein the outer liner and the inner liner define a hot surface side adjacent to the combustion chamber, and a cold surface side adjacent to an oxidizer flow passage, and the downstream wall includes a deflector portion that extends from the cold surface side into the oxidizer flow passage.

The combustor liner according to any preceding clause, wherein the upstream wall and the downstream wall are connected within the combustion chamber, a dilution flow channel being defined between the annular slot dilution opening, the upstream wall and the downstream wall.

The combustor liner according to any preceding clause, wherein the dilution fence further includes (iii) an axial connecting wall, wherein the upstream wall and the downstream wall are connected to the axial connecting wall within the combustion chamber, the dilution flow channel being defined between the annular slot dilution opening, the upstream wall, the downstream wall, and the axial connecting wall.

The combustor liner according to any preceding clause, wherein the axial connecting wall includes a plurality of dilution jets therethrough, the plurality of dilution jets providing a radial flow of the oxidizer from the dilution flow channel to the combustion chamber.

The combustor liner according to any preceding clause, wherein the plurality of dilution openings are provided through at least one of the upstream wall and the downstream wall.

The combustor liner according to any preceding clause, wherein the plurality of dilution openings are provided through the upstream wall, and a plurality of cooling passages are provided through the downstream wall.

The combustor liner according to any preceding clause, wherein the plurality of dilution openings are provided through the upstream wall, and are arranged to direct the flow of the oxidizer through the upstream wall from the dilution flow channel into the combustion chamber at an angle in an upstream direction with respect to the combustor centerline.

The combustor liner according to any preceding clause, wherein both the outer liner and the inner liner include the dilution flow assembly, and the angle in the upstream direction of the flow of the oxidizer through the plurality of dilution openings of the outer liner, and the angle in the upstream direction of the flow of the oxidizer through the plurality of dilution openings of the inner liner, are arranged to converge with one another upstream of the dilution flow assembly.

The combustor liner according to any preceding clause, wherein the plurality of dilution openings of the outer liner, and the plurality of dilution openings of the inner liner, are arranged to provide a flow of oxidizer in the upstream direction so as to oppose a flow of a swirled fuel/oxidizer mixture injected into the combustion chamber by a swirler assembly.

The combustor liner according to any preceding clause, wherein the plurality of dilution openings are arranged through the upstream wall in a plurality of rows of dilution openings, each row of dilution openings extending circumferentially about the combustor centerline, and a first row of the plurality of dilution openings and a second row of the plurality of dilution openings are arranged radially offset from one another with respect to the combustor centerline.

The combustor liner according to any preceding clause, wherein the plurality of dilution openings of the first row are arranged to direct the flow of the oxidizer from the dilution flow channel into the combustion chamber in a first upstream direction, and the plurality of dilution openings of the second row are arranged to direct the flow of the oxidizer from the dilution flow channel into the combustion chamber in a second upstream direction different from the first upstream direction.

The combustor liner according to any preceding clause, wherein the upstream wall is arranged at an upstream wall angle and extends in a downstream direction into the combustion chamber, and the downstream wall is arranged at a downstream wall angle and extends in an upstream direction into the combustion chamber, the upstream wall and the downstream wall defining an apex at a connection between the upstream wall and the downstream wall within the combustion chamber.

The combustor liner according to any preceding clause, wherein the upstream wall angle has a range from ten degrees to one-hundred-sixty degrees, and the downstream wall angle has a range from ten degrees to one-hundred-sixty degrees.

The combustor liner according to any preceding clause, wherein a height of the apex has a range from ten percent to forty-five percent of a distance between the annular slot dilution opening at a hot surface side of the outer liner and the annular slot dilution opening at a hot surface side of the inner liner.

The combustor liner according to any preceding clause, wherein both the outer liner and the inner liner include the dilution flow assembly, the dilution flow assembly of the outer liner being an outer liner dilution flow assembly, and the dilution flow assembly of the inner liner being an inner liner dilution flow assembly.

The combustor liner according to any preceding clause, wherein the apex of the outer liner dilution flow assembly and the apex of the inner liner dilution flow assembly are offset in a longitudinal direction with respect to one another.

The combustor liner according to any preceding clause, wherein the plurality of dilution openings through the upstream wall of the outer liner dilution flow assembly are arranged to direct the flow of the oxidizer in the upstream direction at a first angle, and the plurality of dilution openings through the upstream wall of the inner liner dilution flow assembly are arranged to direct the flow of the oxidizer in the upstream direction at a second angle, a converging flow angle being defined between the first angle and the second angle, the converging flow angle having a range from fifty degrees to one-hundred-eighty degrees.

The combustor liner according to any preceding clause, wherein a radial distance between the apex of the outer liner dilution flow assembly, and the apex of the inner liner dilution flow assembly, has a range from zero percent to forty percent of a radial distance between the annular slot dilution opening at a hot surface side of the outer liner and the annular slot dilution opening at a hot surface side of the inner liner.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor liner for a combustor of a gas turbine, the combustor liner comprising:

an outer liner extending circumferentially about a combustor centerline; and an inner liner extending circumferentially about the combustor centerline, wherein, the outer liner and the inner liner define a combustion chamber therebetween, and at least one of the outer liner and the inner liner includes a dilution flow assembly comprising, (a) an annular slot dilution opening, and (b) a dilution fence extending from an upstream side of the annular slot dilution opening to a downstream side of the annular slot dilution opening, and extending into the combustion chamber, the dilution fence including a plurality of dilution openings therethrough for providing a flow of an oxidizer through the dilution fence into the combustion chamber, wherein the dilution fence includes (i) an upstream wall extending from the upstream side of the annular slot dilution opening into the combustion chamber and (ii) a downstream wall extending from the downstream side of the annular slot dilution opening into the combustion chamber, and wherein the outer liner and the inner liner define a hot surface side adjacent to the combustion chamber, and a cold surface side adjacent to an oxidizer flow passage, and the downstream wall includes a deflector portion that extends from the cold surface side into the oxidizer flow passage.

2. The combustor liner according to claim 1, wherein the plurality of dilution openings are provided through at least one of the upstream wall and the downstream wall.

3. The combustor liner according to claim 2, wherein the plurality of dilution openings are provided through the upstream wall, and a plurality of cooling passages are provided through the downstream wall.

4. The combustor liner according to claim 1, wherein the plurality of dilution openings are arranged through the upstream wall in a plurality of rows of dilution openings, each row of dilution openings extending circumferentially about the combustor centerline, and a first row of the plurality of dilution openings and a second row of the plurality of dilution openings are arranged radially offset from one another with respect to the combustor centerline.

5. The combustor liner according to claim 4, wherein the plurality of dilution openings of the first row are arranged to direct the flow of the oxidizer from the dilution flow channel into the combustion chamber in a first upstream direction, and the plurality of dilution openings of the second row are arranged to direct the flow of the oxidizer from the dilution flow channel into the combustion chamber in a second upstream direction different from the first upstream direction.

6. A combustor liner for a combustor of a gas turbine, the combustor liner comprising:

an outer liner extending circumferentially about a combustor centerline; and an inner liner extending circumferentially about the combustor centerline, wherein, the outer liner and the inner liner define a combustion chamber therebetween, and at least one of the outer liner and the inner liner includes a dilution flow assembly comprising, (a) an annular slot dilution opening, and (b) a dilution fence extending from an upstream side of the annular slot dilution opening to a downstream side of the annular slot dilution opening, and extending into the combustion chamber, the dilution fence including a plurality of dilution openings therethrough for providing a flow of an oxidizer through the dilution fence into the combustion chamber, wherein the dilution fence includes (i) an upstream wall extending from the upstream side of the annular slot dilution opening into the combustion chamber and (ii) a downstream wall extending from the downstream side of the annular slot dilution opening into the combustion chamber, wherein the dilution fence further includes (iii) an axial connecting wall, wherein the upstream wall and the downstream wall are connected to the axial connecting wall within the combustion chamber, a dilution flow channel being defined between the annular slot dilution opening, the upstream wall, the downstream wall, and the axial connecting wall, and wherein the axial connecting wall includes a plurality of dilution jets therethrough, the plurality of dilution jets providing a radial flow of the oxidizer from the dilution flow channel to the combustion chamber.

7. The combustor liner according to claim 6, wherein the plurality of dilution openings are provided through at least one of the upstream wall and the downstream wall.

8. The combustor liner according to claim 7, wherein the plurality of dilution openings are provided through the upstream wall, and a plurality of cooling passages are provided through the downstream wall.

9. A combustor liner for a combustor of a gas turbine, the combustor liner comprising:

an outer liner extending circumferentially about a combustor centerline; and an inner liner extending circumferentially about the combustor centerline, wherein, the outer liner and the inner liner define a combustion chamber therebetween, and at least one of the outer liner and the inner liner includes a dilution flow assembly comprising, (a) an annular slot dilution opening, and (b) a dilution fence extending from an upstream side of the annular slot dilution opening to a downstream side of the annular slot dilution opening, and extending into the combustion chamber, the dilution fence including a plurality of dilution openings therethrough for providing a flow of an oxidizer through the dilution fence into the combustion chamber, wherein the dilution fence includes (i) an upstream wall extending from the upstream side of the annular slot dilution opening into the combustion chamber and (ii) a downstream wall extending from the downstream side of the annular slot dilution opening into the combustion chamber, wherein the upstream wall and the downstream wall are connected within the combustion chamber, a dilution flow channel being defined between the annular slot dilution opening, the upstream wall and the downstream wall, wherein the plurality of dilution openings are provided through the upstream wall, and are arranged to direct the flow of the oxidizer through the upstream wall from the dilution flow channel into the combustion chamber at an angle in an upstream direction with respect to the combustor centerline, and wherein both the outer liner and the inner liner include the dilution flow assembly, and the angle in the upstream direction of the flow of the oxidizer through the plurality of dilution openings of the outer liner, and the angle in the upstream direction of the flow of the oxidizer through the plurality of dilution openings of the inner liner, are arranged to converge with one another upstream of the dilution flow assembly.

10. The combustor liner according to claim 9, wherein the plurality of dilution openings of the outer liner, and the plurality of dilution openings of the inner liner, are arranged to provide a flow of oxidizer in the upstream direction so as to oppose a flow of a swirled fuel/oxidizer mixture injected into the combustion chamber by a swirler assembly.

11. A combustor liner for a combustor of a gas turbine, the combustor liner comprising:

an outer liner extending circumferentially about a combustor centerline; and an inner liner extending circumferentially about the combustor centerline, wherein, the outer liner and the inner liner define a combustion chamber therebetween, and at least one of the outer liner and the inner liner includes a dilution flow assembly comprising, (a) an annular slot dilution opening, and (b) a dilution fence extending from an upstream side of the annular slot dilution opening to a downstream side of the annular slot dilution opening, and extending into the combustion chamber, the dilution fence including a plurality of dilution openings therethrough for providing a flow of an oxidizer through the dilution fence into the combustion chamber, wherein the dilution fence includes (i) an upstream wall extending from the upstream side of the annular slot dilution opening into the combustion chamber and (ii) a downstream wall extending from the downstream side of the annular slot dilution opening into the combustion chamber, wherein the upstream wall is arranged at an upstream wall angle and extends in a downstream direction into the combustion chamber, and the downstream wall is arranged at a downstream wall angle and extends in an upstream direction into the combustion chamber, the upstream wall and the downstream wall defining an apex at a connection between the upstream wall and the downstream wall within the combustion chamber, and wherein both the outer liner and the inner liner include the dilution flow assembly, the dilution flow assembly of the outer liner being an outer liner dilution flow assembly, and the dilution flow assembly of the inner liner being an inner liner dilution flow assembly.

12. The combustor liner according to claim 11, wherein the upstream wall angle has a range from ten degrees to one-hundred-sixty degrees, and the downstream wall angle has a range from ten degrees to one-hundred-sixty degrees.

13. The combustor liner according to claim 11, wherein a height of the apex has a range from ten percent to forty-five percent of a distance between the annular slot dilution opening at a hot surface side of the outer liner and the annular slot dilution opening at a hot surface side of the inner liner.

14. The combustor liner according to claim 11, wherein the apex of the outer liner dilution flow assembly and the apex of the inner liner dilution flow assembly are offset in a longitudinal direction with respect to one another.

15. The combustor liner according to claim 11, wherein the plurality of dilution openings through the upstream wall of the outer liner dilution flow assembly are arranged to direct the flow of the oxidizer in the upstream direction at a first angle, and the plurality of dilution openings through the upstream wall of the inner liner dilution flow assembly are arranged to direct the flow of the oxidizer in the upstream direction at a second angle, a converging flow angle being defined between the first angle and the second angle, the converging flow angle having a range from fifty degrees to one-hundred-eighty degrees.

16. The combustor liner according to claim 11, wherein a radial distance between the apex of the outer liner dilution flow assembly, and the apex of the inner liner dilution flow assembly, has a range from zero percent to forty percent of a radial distance between the annular slot dilution opening at a hot surface side of the outer liner and the annular slot dilution opening at a hot surface side of the inner liner.

* * * * *